US005167533A

United States Patent [19]

Rauwolf

[11] Patent Number: 5,167,533

[45] Date of Patent: Dec. 1, 1992

[54] CONNECTOR FOR COAXIAL CABLE HAVING HOLLOW INNER CONDUCTORS

[75] Inventor: Gerald A. Rauwolf, South Holland, Ill.

[73] Assignee: Andrew Corporation, Orland Park, Ill.

[21] Appl. No.: 818,056

[22] Filed: Jan. 8, 1992

[51] Int. Cl.[5] ..... H01R 17/18

[52] U.S. Cl. ..... 439/583

[58] Field of Search ..... 439/578-585

[56] References Cited

U.S. PATENT DOCUMENTS

| | | | |
|---|---|---|---|
| 4,135,776 | 1/1979 | Ailawadhi et al. | 439/583 |
| 4,408,822 | 10/1983 | Nikitas | 439/583 |
| 4,496,208 | 1/1985 | Spinner et al. | 439/583 |

*Primary Examiner*—Joseph H. McGlynn
*Attorney, Agent, or Firm*—Arnold, White & Durkee

[57] ABSTRACT

A connector assembly for a coaxial cable having an outer conductor and a hollow inner conductor, has a flaring ring and a clamping member having opposed bevelled surfaces for engaging the respective inner and outer surfaces of the outer conductor of the cable. A body member draws and holds the bevelled surfaces of the flaring ring and the clamping member together against opposite surfaces of the outer conductor of the cable. A conductive contact sleeve fits inside the hollow inner conductor and is divided longitudinally into at least two rigid segments, the inner surfaces of the segments tapering outwardly at at least one end thereof. An elongated flaring member fits inside the contact sleeve, and the outer surface of the flaring member tapers outwardly at one end thereof for engaging the tapered inner surfaces of the segments so that the flaring member forces the segments outwardly into tight engagement with the inside surface of the inner conductor as the flaring member is advanced longitudinally into the contact sleeve.

7 Claims, 4 Drawing Sheets

CONNECTOR FOR COAXIAL CABLE HAVING HOLLOW INNER CONDUCTORS

FIELD OF THE INVENTION

The present invention relates generally to connectors for coaxial cables, and, more particularly, to connectors for coaxial cables having hollow inner conductors.

BACKGROUND OF THE INVENTION

Connectors for coaxial cable having hollow inner conductors are generally used throughout the semi-flexible coaxial cable industry. For example, Juds et al. U.S. Pat. No. 4,046,451 describes a connector for coaxial cables having annularly corrugated outer conductors and plain cylindrical inner conductors. Van Dyke U.S. Pat. No. 3,291,895 describes a connector for cables having helically corrugated inner and outer conductors. A connector for a coaxial cable having a helically corrugated outer conductor and a plain cylindrical inner conductor is described in Johnson et al. U.S. Pat. No. 3,199,061.

One of the problems with present techniques for making connections to hollow inner conductors of coaxial cables is that they are unable to compensate for variations in the size of the cable conductors due to manufacturing tolerances and the like. Another problem is non-uniform connections which lead to variations in the electrical zone lengths in the connections, which in turn leads to variations in the electrical performance characteristics, such as the VSWR, of the resulting connections.

SUMMARY OF THE INVENTION

It is a primary object of the present invention to provide an improved connector for coaxial cables having hollow inner conductors, which automatically compensates for variations in the size of the inner conductor of the cable, thereby providing improved consistency in the VSWR and other electrical performance characteristics of the resulting connections.

It is another object of this invention to provide such an improved connector which can be easily and quickly installed, or removed and re-installed, under field conditions without the use of any special tools.

A further object of this invention is to provide such an improved connector which has only a small number of parts.

Still another object of this invention is to provide such an improved connector which can be efficiently and economically manufactured.

Other objects and advantages of the invention will be apparent from the following detailed description and the accompanying drawings.

In accordance with the present invention, the foregoing objectives are realized by providing a connector assembly for a coaxial cable having an outer conductor and a hollow inner conductor, the connector assembly has a flaring ring and a clamping member having opposed bevelled surfaces for engaging the respective inner and outer surfaces of the outer conductor of the cable, a body member having means for drawing and holding the bevelled surfaces of the flaring ring and the clamping member together against opposite surfaces of the outer conductor of the cable, a conductive contact sleeve dimensioned to fit inside the hollow inner conductor and divided longitudinally into at least two rigid segments, the inner surfaces of the segments tapering outwardly at least at one end thereof, an elongated flaring member dimensioned to fit inside the contact sleeve, the outer surface of the flaring member tapering outwardly at one end thereof for engaging the tapered inner surfaces of the segments so that the flaring member forces the segments outwardly as the flaring member is advanced longitudinally into the contact sleeve, and cooperating interlock means on the segments and the flaring member for preventing relative rotational movement, while permitting relative longitudinal movement, therebetween.

DESCRIPTION OF THE PREFERRED EMBODIMENT

Figure 1:
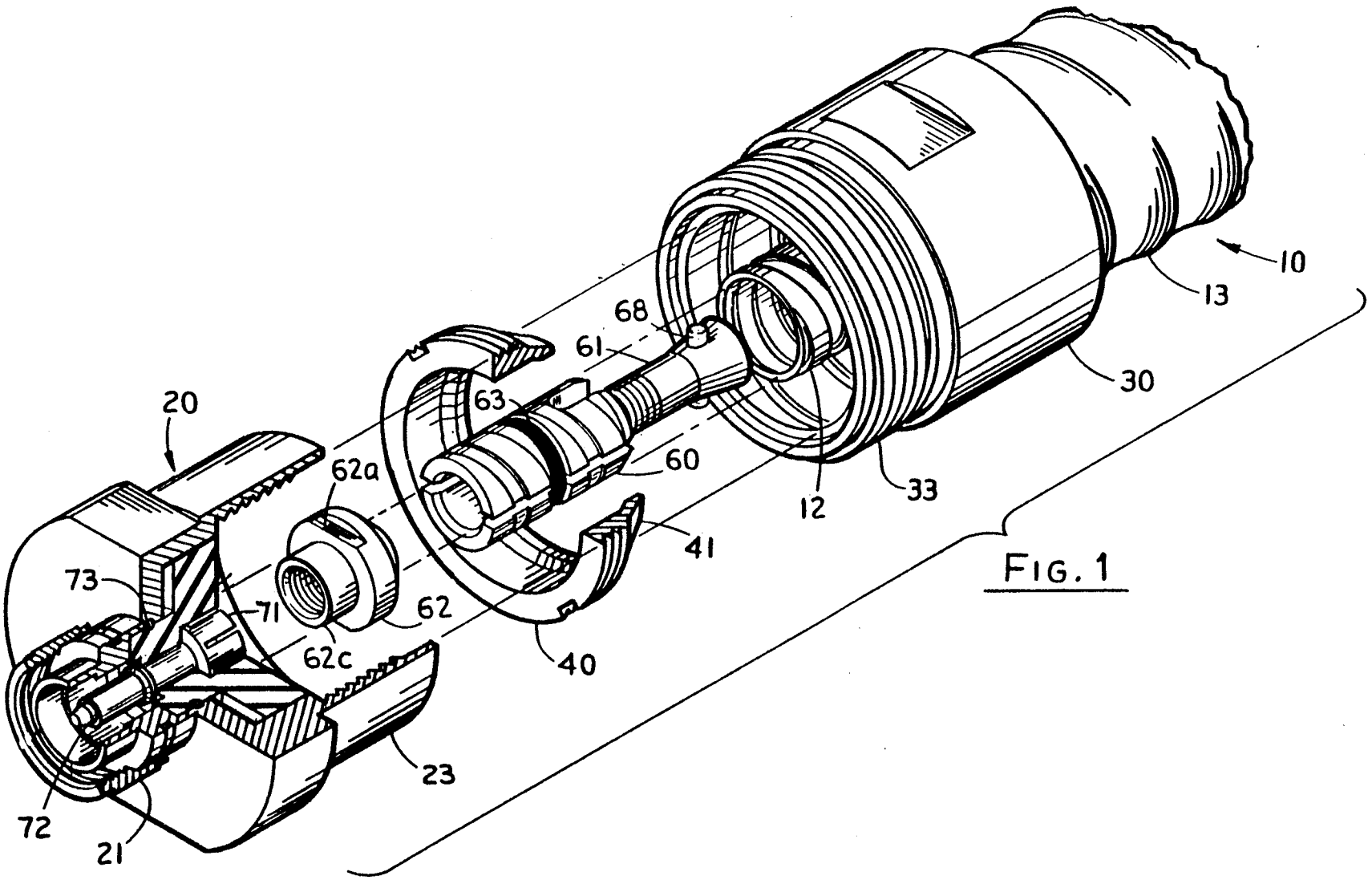
FIG. 1 is a perspective view of a coaxial cable connector embodying the present invention.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings, there is shown a connector assembly for a coaxial cable 10 having a helically corrugated outer conductor 11 concentrically spaced from a helically corrugated inner conductor 12 by a dielectric spacer (not shown). As is well known to those familiar with this art, a helically corrugated conductor is distinguished from an annularly corrugated conductor in that the helical corrugations form a continuous pattern of corrugation crests and roots along the length of the cable such that each crest is opposite a root along the circumference of the conductor. Consequently, any transverse cross-section taken through the conductor perpendicular to its axis is radially asymmetrical, which is not true of annularly corrugated conductors.

To prepare the cable 10 for attachment of the connector assembly, the end of the cable is cut along a plane extending perpendicular to the axis of the cable and through the apex of one of the crests of the corrugated outer conductor 11. This exposes the clean and somewhat flared internal surface of the outer conductor 11. Any burrs or rough edges on the cut ends of the metal conductors 11 and 12 are preferably removed to avoid interference with the connector. The outer surface of the outer conductor 11 is normally covered with a plastic jacket 13 which is trimmed away from the end of the outer conductor 11 along a sufficient length to accommodate the connector assembly.

A stepped cylindrical body member 20 extends around the cut end of the coaxial cable 10. The reduced-diameter end portion of the body member 20 carries a conventional coupling nut 21. This coupling nut 21 is secured to the body member 20 by a spring retaining ring 22 which holds the nut 21 captive on the body member 20 while permitting free rotation of the nut 21 on the member 20. As will be apparent from the ensuing description, this coupling nut 21 ensures reliable electrical connection to the outer conductor 11 of the cable 10, and is insulated from the inner conductor 12.

A clamping member 30 has a threaded inner surface 31 to match the helical corrugations of the outer conductor 11. Thus, the member 30 can be threaded onto the outer conductor 11 until at least a major portion of a conically bevelled surface 32 on the end of the clamping member 30 overlaps the outer conductor 11. The conically bevelled surface 32 slopes inwardly toward the threaded inner surface 31 of the clamping member 30.

Figure 3:
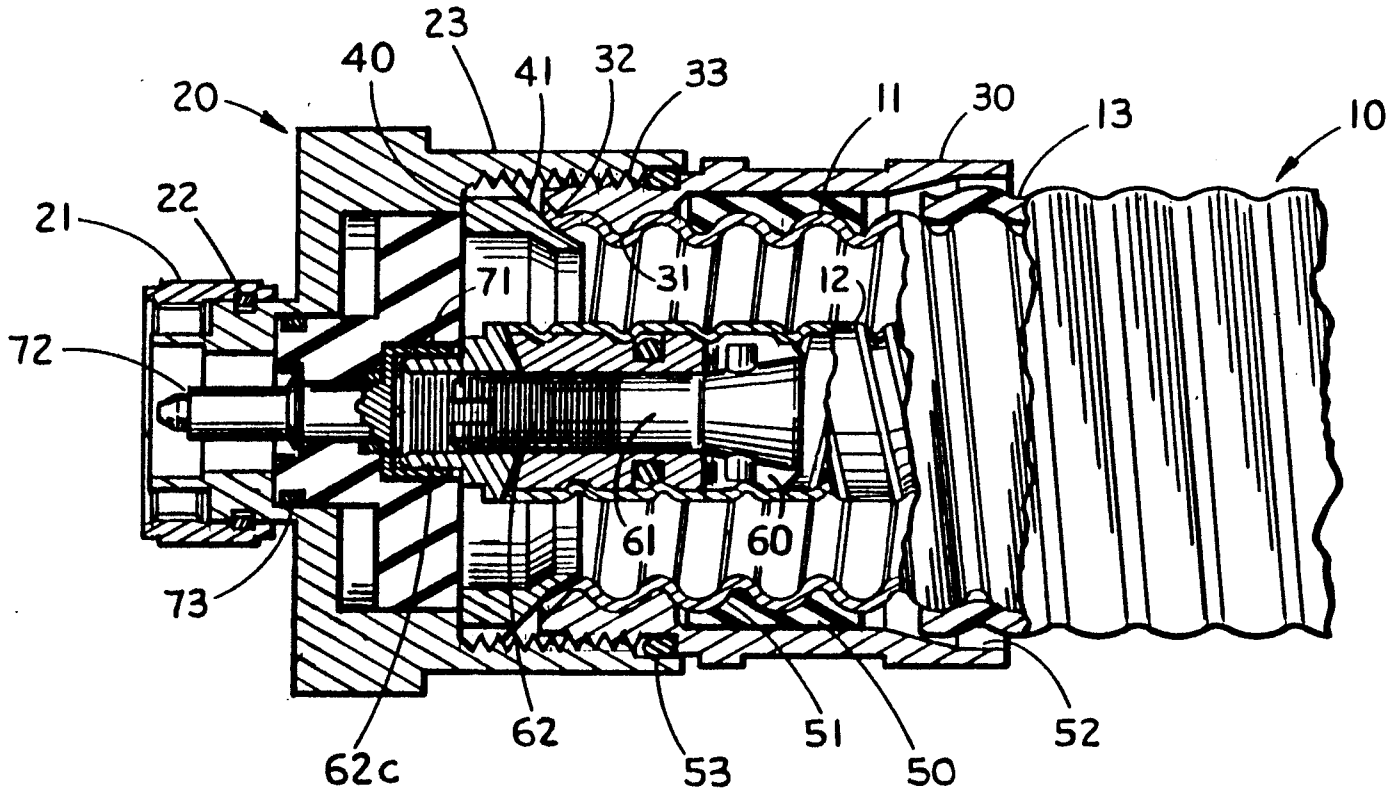
FIG. 3 is a longitudinal sectional view of the connector shown in FIG. 1 with the connector fully assembled.

To make electrical connection with the inner surface of the outer conductor 11 of the coaxial cable 10, a flaring ring 40 is threaded into the body member 20. The forward end of the ring 40 forms a conically bevelled surface 41 which matches the bevelled surface 32 on the clamping member 30. The inside diameter of the forward end of the flaring ring 40 is at least as small as the minor inside diameter of the outer conductor 11, so that the bevelled surface 41 will engage the inner surface of the end portion of the outer conductor 11 around the entire circumference of the cut end. As illustrated in FIG. 3, the bevelled surface 41 acts to flare the end of the outer conductor 11 outwardly as the flaring ring is forced into the outer conductor during assembly of the connector, i.e., as the clamping member 30 and the body member 20 are threaded together. Consequently, the connector is self-flaring, and there is no need to manually flare the end of the outer conductor with a pliers or other tool. In the illustrative embodiment, the surface 41 is bevelled at an angle of about 30° at the forward end and about 45° at the rear end, so that the initial flaring action is more gradual than the final flaring action. The optimum angle of the bevelled surface 41 for any given application is dependent on the size of the coaxial cable 10.

Because the inside diameter of the forward end of the flaring ring 40 is smaller than the minor inside diameter of the outer conductor 11 of the coaxial cable, the flaring ring tends to cause a slight increase in the VSWR of the transmission line. To minimize this effect caused by the forward end of the flaring ring, the inside diameter of the rear portion of the flaring ring is slightly larger than the minor inside diameter of the outer conductor 11. Moreover, the transition between the two different inside diameters of the flaring ring 40 is located close to the forward end of the flaring ring.

For the purpose of drawing the flaring ring 40 and the clamping member 30 firmly against opposite sides of the flared end portion of the outer conductor 11, the body member 20 and the clamping member 30 include respective telescoping sleeve portions 23 and 33 with cooperating threaded surfaces. Thus, when the body member 20 is threaded onto the clamping member 30, the two members are advanced toward each other in the axial direction so as to draw the flaring ring 40 and the clamping member 30 into electrically conductive engagement with the outer conductor 11. When the flared end portion of the outer conductor 11 is clamped between the bevelled surface 41 of the flaring ring 40 and the bevelled surface 32 of the clamping member 30, it is also at least partially flattened to conform with the planar clamping surfaces. To disengage the connector assembly, the body member 20 is simply threaded off the clamping member 30 to retract the two members away from each other until their threaded surfaces are disengaged.

To provide a moisture barrier between the inner surface of the clamping member 30 and the outer surface of the outer conductor 11, a gasket 50 is positioned within the cylindrical portion of the clamping member behind the threaded inner surface 31. The gasket 50 has a threaded inner surface 51 to match the helical corrugations of the outer conductor 11. When the clamping member 30 is threaded onto the outer conductor 11, the gasket 50 compresses slightly so that the gasket bears firmly against both the outer surface of the conductor 11 and the inner surface of the clamping member 30. The adjacent end portion of the clamping member 30 forms a slightly enlarged recess 52 so that it can fit over the end of the polymeric jacket 13 on the coaxial cable 10. A moisture barrier is also provided by an O-ring 53 positioned between the opposed surfaces of the sleeve portions 23 and 33 of the members 20 and 30, respectively.

Electrical contact with the inner conductor 12 of the cable 10 is effected by an inner contact sleeve 60 forming a threaded outer surface which meshes with, and makes electrical contact with, the inside surface of the hollow inner conductor 12. The sleeve 60 is split longitudinally so that it is in two parts, **60*a* and 60*b*, each of which is semi-cylindrical in shape. The sleeve 60 carries with it an internal flaring stub 61, a collar 62 threaded onto the free end of the stub 61 outside the conductor 12, and an O-ring 63 for holding together the two parts of the contact sleeve 60. Flats 62*a* and 62*b* are formed on the collar 62 to facilitate engagement of the collar 62** with a wrench.

The inner contact assembly comprising the sleeve 60, the stub 61, the collar 62 and the O-ring 63 is initially threaded into the helically corrugated inner conductor 12, using a screwdriver inserted into a slot **61*a* in the rear end of the stub 61. During this insertion, the two sections of the split sleeve 60 are in their collapsed positions (shown in solid lines in FIGS. 4 and 5) so as to minimize the interference between the sleeve 60 and the conductor 12, thereby facilitating the initial insertion of the contact assembly. Then after the contact assembly has been inserted, the two sections of the sleeve 60 are expanded (as shown in broken lines in FIGS. 4 and 5) into intimate contact with the conductor 12**.

Figure 2:
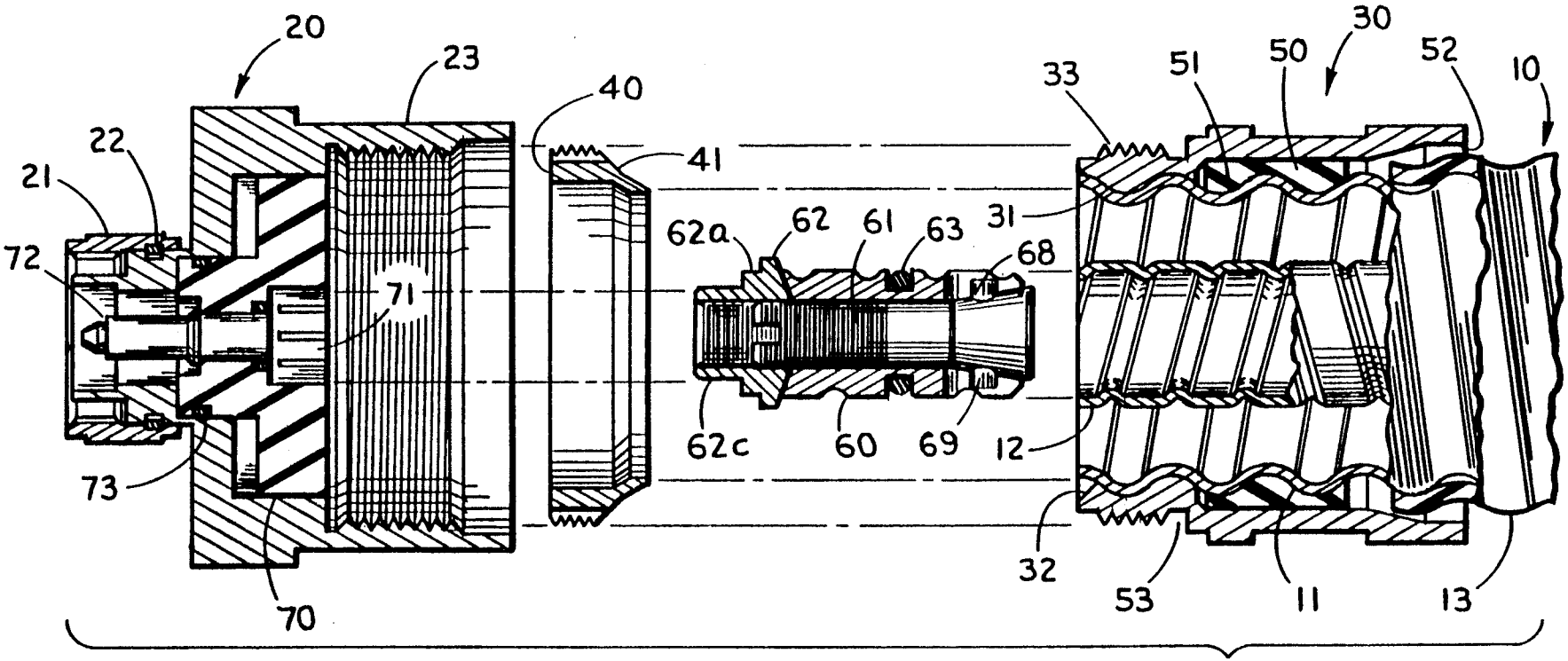
FIG. 2 is a longitudinal sectional view of the connector shown in FIG. 1 with only two of the parts attached to the coaxial cable.
Figure 4:
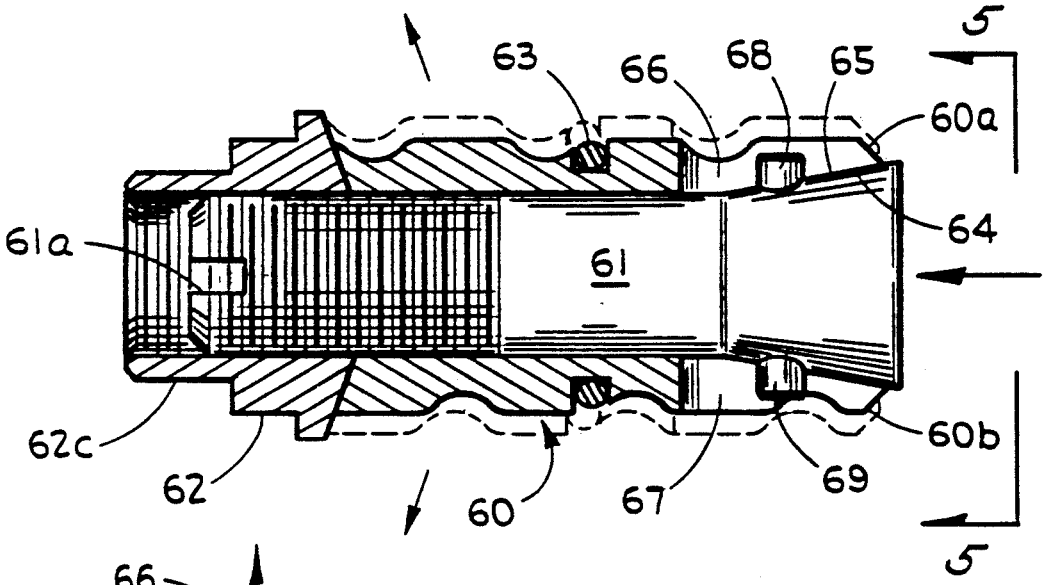
FIG. 4 is an enlarged longitudinal section of the inner contact assembly in the connector of FIGS. 1–3, with the expanded positions of the contact sleeve segments illustrated in broken lines.

For the purpose of expanding the split sleeve 60 tightly against the inside surface of the inner conductor 12, the mating surfaces 64 and 65 of the forward portions of the sleeve 60 and the stub 61, respectively, are tapered to form identical frusto-conical surfaces. The forward end of the sleeve 60 also forms a pair of longitudinal slots 66 and 67 which receive a pair of lugs 68 and 69 on the stub 61, so as to form an interlock which allows longitudinal movement of the sleeve 60 and the stub 61 relative to each other without allowing relative rotational movement between those two members. As the stub 61 is moved longitudinally within the sleeve 60 (from right to left as viewed in FIGS. 1–4), the wedging action of the tapered surfaces 64 and 65 expands the split sleeve 60 to force it into firm engagement with the inside surface of the conductor 12. As can be seen in FIGS. 2–4, the radii of the outermost surfaces of the stub 61 and its lugs 68 and 69 must be smaller than the minor inside diameter of the corrugated conductor 12.

Figure 5:
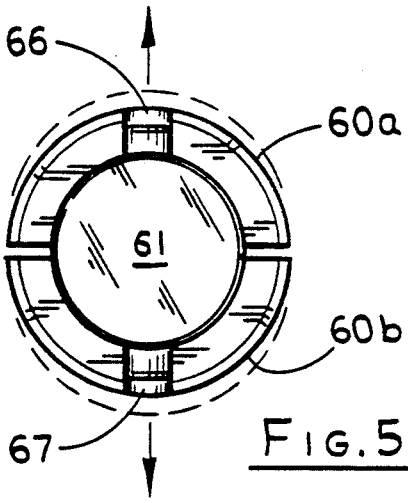
FIG. 5 is an end elevation taken generally along the line 5—5 in FIG. 4, and again illustrating the expanded positions of the contact sleeve segments in broken lines.

Movement of the stub 61 relative to the sleeve 60 is effected by threading the collar 62 onto the stub 61 until the collar 62 engages the sleeve 60, and then continuing to turn the collar 62 so that the stub 61 is drawn into the sleeve 60. This causes the tapered surface 65 on the forward end of the stub 61 to expand the split sleeve 60, as illustrated in FIGS. 4 and 5, thereby forcing the outer surface of the sleeve 60 into tight engagement with the inner conductor 12. This expansion begins at the right-hand end of the sleeve 60, as viewed in FIG. 4, but the left-hand end also expands after the right-hand end engages the conductor 12.

By measuring the torque applied to the collar 62, and always stopping the expansion of the sleeve 60 at the same torque level, uniform electrical contact between the sleeve 60 and the conductor 12 may be consistently achieved regardless of dimensional variations in the conductor 12 due to manufacturing tolerances. The range of expansion of the split sleeve 60 is much greater than the range of dimensional variations in the conductor 12, and thus the expansion of the sleeve 60 can be controlled to compensate for variations in the dimensions of the conductor 12. This compensation feature permits connections to be made with consistent VSWR and other electrical performance characteristics.

An insulating sleeve 70 electrically isolates the inner and outer connector elements from each other. It will be noted that the interior of the body member 20 includes a stepped recess for receiving the insulator 70.

To make electrical contact with the contact sleeve 60, the collar 62 has a reduced-diameter head portion 62*c* which fits into multiple spring fingers 71 formed as integral parts of the base of a connector pin 72. The spring fingers 71 fit over and snugly against the outer surface of the head 62*c*. The pin 72, which forms the male portion of a conventional connector, is held in place within the connector assembly by the insulating sleeve 70 whose innermost surface is complementary with the outer surface of the pin 72. An O-ring 73 forms an air seal between the sleeve 70 and the body member 20.

Figure 6:
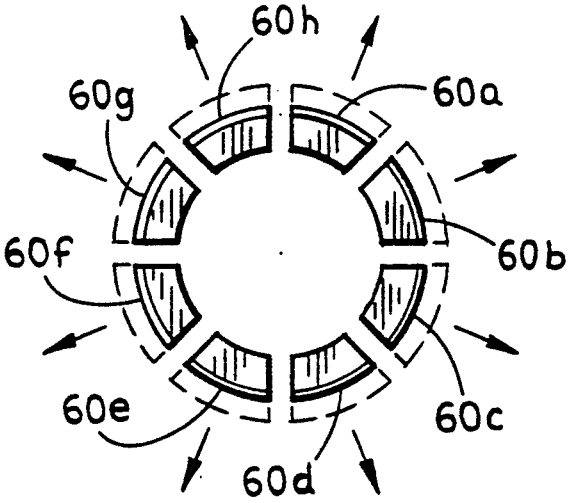
FIG. 6 is an end elevation of a modified contact sleeve for use in the assembly of FIGS. 4 and 5.

As illustrated in FIG. 6, the inner contact sleeve 60 may be split into a multiplicity of segments 60*a*–60*h* rather than just two segments. A circumferential groove is formed in the outer surfaces of all the segments for receiving the O-ring 63 which holds the segments together prior to and during insertion thereof into the inner conductor 12. The inside surfaces of the forward ends of all segments are tapered so that the contact sleeve formed by the combination of all the segments forms a frusto-conical surface which cooperates with the frusto-conical surface on the flaring member 61.

As can be seen from the foregoing detailed description of the illustrative embodiment of the invention, the improved connector assembly provided by this invention is easy to install or re-install even under adverse field conditions. The connector assembly has a small number of parts to minimize the possibility of loss of parts during installation, self-flaring, and does not require any preliminary manual flaring operations prior to the installation of the connector assembly. Most importantly, the connector is capable of compensating for variations in the dimensions of the inner conductor, so that consistent electrical performance can be achieved over a large number of connections.

I claim:

1. A connector assembly for a coaxial cable having an outer conductor and a hollow inner conductor, the connector assembly comprising, a flaring ring and a clamping member having opposed bevelled surfaces for engaging the respective inner and outer surfaces of the outer conductor of the cable, a body member having means for drawing and holding the bevelled surfaces of said flaring ring and said clamping member together against opposite surfaces of the outer conductor of the cable, a conductive contact sleeve dimensioned to fit inside said hollow inner conductor and divided longitudinally into at least two rigid segments, the inner surfaces of said segments tapering outwardly at at least one end thereof, and an elongated flaring member dimensioned to fit inside said contact sleeve, the outer surface of said flaring member tapering outwardly at one end thereof for engaging said tapered inner surfaces of said segments so that said flaring member forces said segments outwardly as said flaring member is advanced longitudinally into said contact sleeve.

2. The connector assembly of claim 1 wherein the inner conductor of said coaxial cable is helically corrugated, and the outer surfaces of said segments are threaded to mesh with the helical corrugations in the inner conductor.

3. The connector assembly of claim 1 wherein a portion of the outer surface of said flaring member is threaded at the end opposite the tapered end thereof, and which includes an internally threaded collar adapted to be threaded onto the threaded end of said flaring member, so that said collar engages said contact sleeve and draws said flaring member into said contact sleeve to expand the segments thereof into tight engagement with the inside surface of said inner conductor.

4. The connector assembly of claim 1 wherein the outer surfaces of said sleeve segments forms a circumferential groove, and an O-ring is seated in said groove to hold the segments together prior to and during the insertion thereof into said inner conductor.

5. The connector assembly of claim 1 wherein said interlock means comprises a pair of longitudinal slots in said sleeve segments, and a pair of lugs formed on said flaring member and projecting into said slots.

6. The connector assembly of claim 1 wherein said flaring member is a cylindrical rod having an outer surface which is threaded at one end and frusto-conical at the other end.

7. The connector assembly of claim 1 which includes cooperating interlock means on said segments and said flaring member for preventing relative rotational movement, while permitting relative longitudinal movement, therebetween.

* * * * *